US006650210B1

(12) United States Patent
Raklyar et al.

(10) Patent No.: US 6,650,210 B1
(45) Date of Patent: Nov. 18, 2003

(54) ELECTROMECHANICAL SWITCH DEVICE

(75) Inventors: Aron Raklyar, Brooklyn, NY (US); Iosif Royt, Flushing, NY (US)

(73) Assignee: Scientific Components, Brooklyn, NY (US)

( * ) Notice: Subject to any disclaimer, the term of this patent is extended or adjusted under 35 U.S.C. 154(b) by 0 days.

(21) Appl. No.: 10/385,160

(22) Filed: Mar. 11, 2003

(51) Int. Cl.[7] ..... H01H 51/30; H01H 9/00; H01P 1/12

(52) U.S. Cl. ..... 335/4; 335/156; 200/504

(58) Field of Search ..... 335/4, 5, 83, 133, 335/156, 196; 333/105; 200/16 R, 51.04, 504

(56) References Cited

U.S. PATENT DOCUMENTS 4,298,847 A * 11/1981 Hoffman ..... 333/105
4,697,056 A * 9/1987 Hoffman ..... 200/504
4,908,588 A * 3/1990 Hoffman et al. ..... 333/105
5,499,006 A * 3/1996 Engel et al. ..... 335/4
5,642,086 A * 6/1997 Nelson ..... 335/4
5,652,558 A * 7/1997 Leikus et al. ..... 335/4
5,699,030 A * 12/1997 Leikus et al. ..... 335/4
5,724,014 A * 3/1998 Leikus et al. ..... 335/4
5,815,049 A * 9/1998 Cappelli ..... 333/106
5,815,057 A * 9/1998 Hoffman et al. ..... 335/4
5,894,255 A * 4/1999 Wallintin ..... 335/80
6,037,849 A * 3/2000 Ciezarek ..... 335/4
6,043,440 A * 3/2000 Sun et al. ..... 200/51.04
6,124,771 A * 9/2000 Kim et al. ..... 335/4
6,133,812 A * 10/2000 Magda ..... 335/4
6,204,740 B1 * 3/2001 Nakahata ..... 335/4
6,211,756 B1 * 4/2001 Sun et al. ..... 335/4
6,337,612 B1 * 1/2002 Kim et al. ..... 335/4
6,340,923 B1 * 1/2002 Yamanaka et al. ..... 335/4

* cited by examiner

*Primary Examiner*—Ramon M. Barrera
(74) *Attorney, Agent, or Firm*—Kevin Redmond

(57) ABSTRACT

A relay switching device for switching high frequency signals has high reliability and stable insertion loss. The switching device has a housing with a base and a case. The case has a bore and the base has a slot. An electromagnet is mounted in the case. A reed holder has a pair of ends. One end of the reed holder is mounted in the bore adjacent the electromagnet. A pair of terminals are mounted in the base and extend into the slot. A guide member is mounted in the slot. A conductive reed is mounted to the other end of the reed holder. The reed is supported by the guide member and extends over the terminals. The electromagnet moves the reed between an open and closed position. The guide member prevents rotation of the reed as it moves between the open and closed positions.

38 Claims, 6 Drawing Sheets

ELECTROMECHANICAL SWITCH DEVICE

BACKGROUND

1. Field of the Invention

This invention relates to electro-mechanical relays for switching high frequency signals with high reliability and stable insertion loss.

2. Description of Related Art

Many different types of switches are known for switching of radio frequency signals and other signals. Some switch types include, spring actuated contacts, electromagnetic actuators, plungers with permanent magnets, articulated joints and other movable elements. Examples of these types of switches are shown in U.S. Pat. Nos. 6,340,923, 6,337,612, 6,211,756, 6,204,740, 6,124,771, 5,894,255, 5,815,049, 5,724,014, 5,699,030, 5,652,558 and 5,499,006. Unfortunately, these switch types suffer from poor reliability, slow response time, low switch lifetime and short circuits between switch components.

Other examples of RF switches are shown in U.S. Pat. Nos. 4,298,847, 4,697,056, 4,908,588, 6,037,849 and 6,133,812. The RF switches shown in these patents use several cylindrical guide pins to guide the reed conductors in an up and down motion preventing contact between the reed conductors and the walls of the surrounding RF channels. In other words, the guide pins prevent short circuiting of the reed conductors. The electro-mechanical switches of these patents also have dielectric guide pins. The contact area between a flat surface of the conductor reed and a cylindrical surface of the dielectric guide pin has the shape of a line. These guide pins have to be precisely located in order to obtain a small clearance between the dielectric guide pins and the conductor reeds. The flat side surfaces of the conductor reeds continually interact with the cylindrical surface of the guide pins during their movement causing wear of the guide pins and shortening the life of the switch. One way to reduce wear is to increase the number of guide pins. Unfortunately, this causes the RF switch to be larger and more expensive. Additional guide pins also reduce the electrical performance of the switch.

One method to reduce wear of the guide pins is to increase the contact area between the guide pins and the conductor reeds. This method is illustrated in U.S. Pat. Nos. 5,642,086 and 5,815,057. Even with the prior art devices, a need remains for a coaxial RF switch that has a high lifetime and high reliability with precision movement.

While various RF switches have previously been used, they have suffered from unstable insertion loss, poor reliability, slow response time, low switch lifetime, short circuits and are expensive to produce.

A current unmet need exists for an improved RF switch for coaxial transmission lines that overcomes the deficiencies of the prior art.

SUMMARY

It is a feature of the invention to provide an electromechanical relay for switching high frequency signals that has high reliability and low failure rates.

Another feature of the invention is to provide an electromechanical relay for switching high frequency signals that has stable insertion loss and is manufacturable at a low cost.

Another feature of the invention to provide an electromagnetic switching device that includes a housing having a base and a case. The case has a bore and the base has a slot.

An electromagnet is mounted in the case. A reed holder has a first and second end. The first end is mounted in the bore adjacent the electromagnet. A first and second terminal are mounted in the base and extend into the slot. A guide member is mounted in the slot. An electrically conductive reed is mounted to the second end of the reed holder. The reed is supported by the guide member and extends over the terminals. The electromagnet is adapted to move the reed between a closed position in which the first and second terminals are electrically connected and an open position in which the first and second terminals are electrically disconnected. The guide member prevents rotation of the reed as it moves between the open and closed positions.

BRIEF DESCRIPTION OF THE DRAWINGS

It is noted that the drawings of the invention are not to scale. In the drawings, like numbering represents like elements between the drawings.

DETAILED DESCRIPTION

Figure 1:
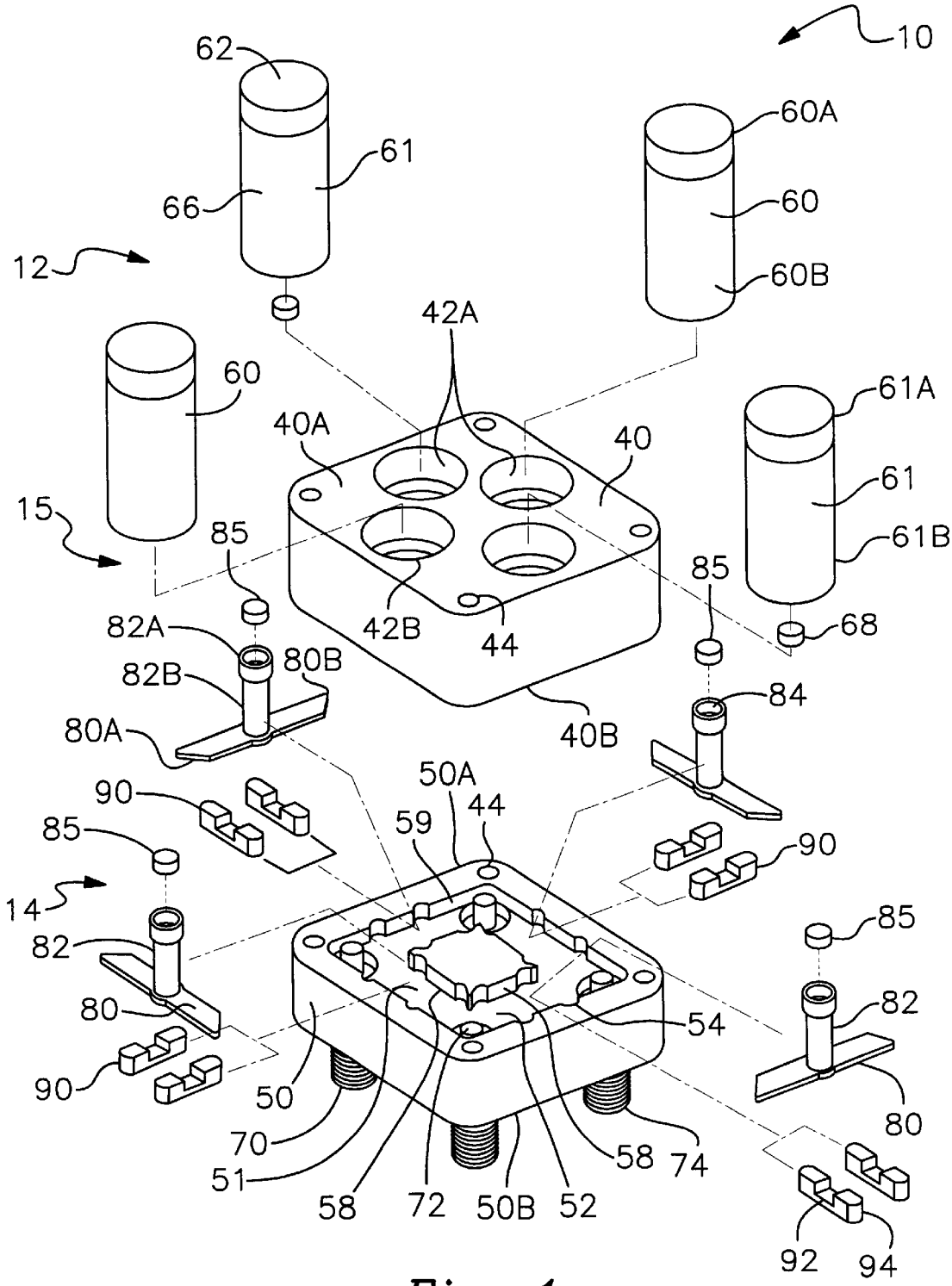
FIG. 1 is an exploded perspective view of the preferred embodiment of an electromagnetic switch according to the present invention.
Figure 2:
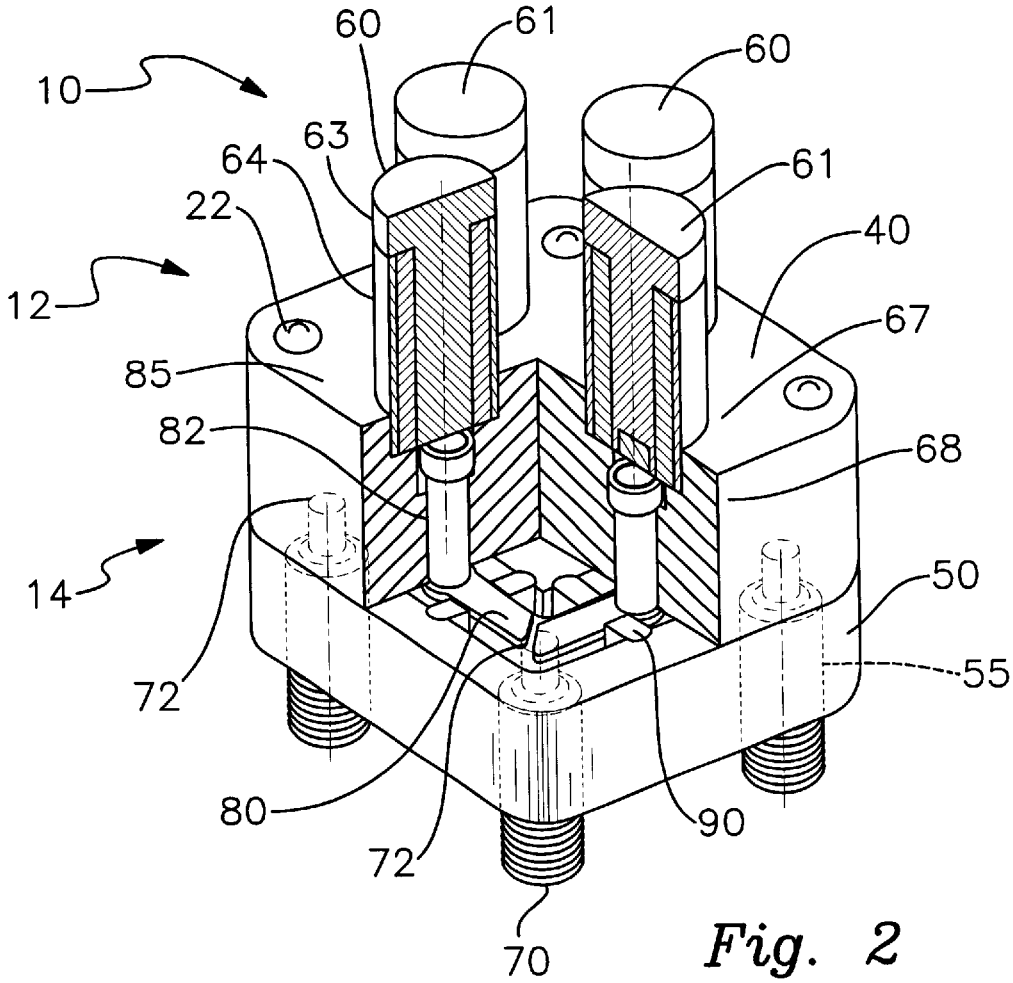
FIG. 2 is an assembled partial cut away view of FIG. 1.
Figure 3:
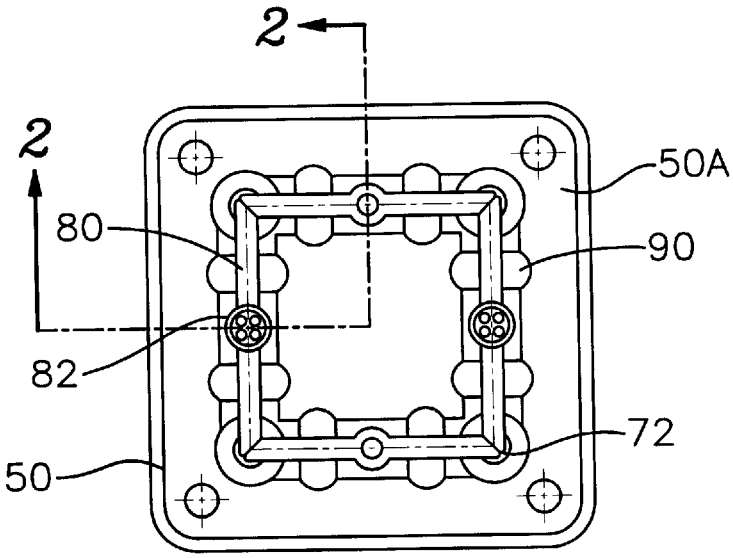
FIG. 3 is a top view of the RF subassembly of FIG. 1.

Referring to FIGS. 1–4, a co-axial electromagnetic transfer switch 10 according to the present invention is shown. Switch 10 has an actuator sub-assembly 12 and a radio frequency (RF) sub-assembly 14. Switch 10 is held in a housing 15. Housing 15 has a case 40, and a base 50. Screws or bolts 22 hold the housing 15 together.

The actuator sub-assembly 12 includes a case 40 and actuators 60 and 61. Case 40 has a top surface 40A and bottom surface 40B. Case 40 has four bores 42B with counterbores 42A that extend through case 40. Holes 44 extend through case 40 for screws 22.

An actuator or electromagnet 60 is mounted in two of bores 42. An actuator or electromagnet 61 is mounted in two of bores 42. Actuators 60 and 61 have an upper end 60A, 61A and a lower end 60B, 61B. Actuators 60 and 61 have a ferromagnetic core 62 that are wound with wires to form coils or windings 64. Core 62 and windings. 64 are mounted inside a hollow case or tube 66. Actuators 61 have a lower cavity 67 in core 62 that contains a fixed permanent magnet 68. The windings 64 are connected with a switchable source of electricity (not shown). The windings are wound so that the polarity of the generated magnetic field, when electricity is connected, is opposite that of the permanent magnet 68. In other words, the permanent magnet 68 will be repelled by the electromagnet when it is energized.

RF subassembly 14 has a base 50 with a fully sealed path or RF channel 51 that is sealed against electromagnetic interference. RF channel 51 is precision machined to produce a 50 ohm impedance. The fully sealed RF path or channel 51 is completely sealed against electromagnetic interference. Base 50 has a top surface 50A and a bottom surface 50B. Four adjoining slots 52 are located in top surface 50A. A center portion 53 is located adjacent to slots 52. Inner walls 58 are located on center portion 53. Outer walls 59 define slots 52. Recesses 54 are located in inner walls 58 and outer walls 59. Four terminal holes 55 extend from bottom surface 50B to the bottom of slots 52. Four bolt holes 44 extend through base 50.

Terminals 70 are affixed in terminal holes 55. Terminals 70 can be 50 ohm coaxial SMA connectors or TNC-type or type N radio frequency connectors. Terminals 70 can be press-fit or held by threads in holes 55. Terminals 70 have a contact tip 72 and a connector end 74. Contact tip 72 extends into slots 52 and is gold plated.

Four electrically conductive reeds 80 are located in slots 52. Reeds 80 have ends 80A and 80B. Reeds 80 are preferably made from a non-magnetic metal and are gold plated. Each of the connector reeds 80 is connected with a dielectric reed holder 82. Reed holder 82 is formed from polychlorotrifluoroethylene (PCTFE) material or another dielectric material. Reed holder 82 has ends 82A and 82B. End 82B is mounted to the middle of reed 80. Reed holder end 82A extends into bore 42B. Reed holder 82 slides within bore 42B. Each reed holder end 82A has a cavity 84 that holds a permanent magnet 85. The polarity of permanent magnets 85 is opposite to the polarity of the other permanent magnets 68 mounted in cavity 67. The reed holders 82 are mounted coaxial to the corresponding axis of bores 42 and electromagnets 60 or 61.

A U-shaped guide member 90 is mounted into recesses 54. Reed 80 resides in and is supported by guide member 90. Guide member 90 has a base 92 with posts 94 extending from the base. The posts 94 partially reside in recesses 54. Two guide members 90 are located in each slot with the reed holder 82 mounted in between guide members 90. Guide members 90 are made from an insulative dielectric material such as PCTFE. Reed 80 is slidably held for up and down movement by posts 94. Guide member 90 increases the lifetime of the RF switch by reducing stresses in the contact area between reeds 80 and guide posts 94. The use of guide member 90 reduces the switch cost by allowing the dimensions of the slot to be less precise than would otherwise be required. This eliminates cost consuming manufacturing operations such as material cutting and assembly.

Figure 4:
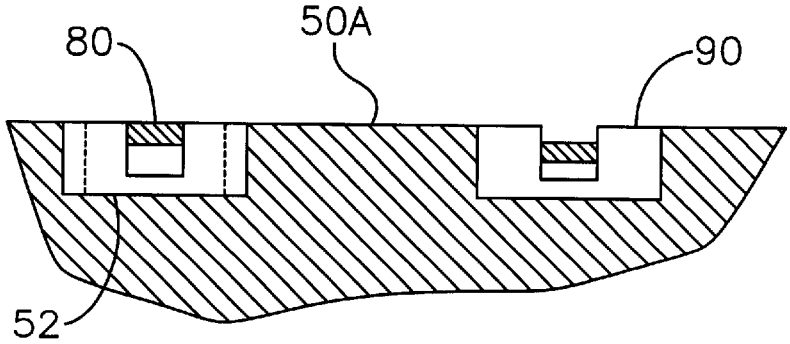
FIG. 4 is a cross-sectional view of the RF subassembly of FIG. 1.

During operation, the reeds 80 are moved a relatively small distance by the magnetic attraction or repulsion of electromagnets 60 and 61 to make or break contacts between the terminals 70. The electromagnetic switch device 10 operates in two different modes, de-energized (shown in FIGS. 2 and 4) and energized. When electromagnets 60 and 61 are not connected to a power source or activated (de-energized condition), two of the reeds 80 will be in contact with the terminals and two will not be in contact. For electromagnets 60, the magnet 85 will be magnetically attracted to core 62 resulting in the movement of reed 80 away from terminals 70 to an open position (FIG. 4 left side). For electromagnets 61, the magnet 85 will be magnetically repulsed by magnet 68 resulting in the movement of reed 80 toward terminals 70 to a closed position (FIG. 4 right side). Magnets 68 and 85 are of opposing polarities. In the closed position, the ends of reed 80 are on top of contact tips 72 providing an electrical connection between the terminals 70. In the open position, reed 80 will contact with bottom side 40B of case 40. Reed holders 82 slide in bores 42 as the reeds move between the open and closed positions.

When electromagnets 60 and 61 are connected to a power source or activated two of the reeds 80 will be in contact with the terminals and two will not be in contact. For electromagnets 60, the magnet 85 will be magnetically repulsed to core 62 when it is energized. This results in the movement of reed 80 toward terminals 70 to a closed position. For electromagnets 61, the magnets 85 and 68 will be magnetically attracted to core 62 resulting in the movement of reed 80 away from terminals 70 to an open position. Electromagnet 61 is strong enough to overcome the repulsive force between magnets 68 and 85 when it is energized.

During the movement of reeds 80 from an open to a closed position, the conductive reeds will continuously be aligned and guided by guide member 90. The guide members prevent the parasitic rotation of the reeds around the axis of the reed holder. The surface contact area between the sides of the reeds and the side walls of the posts 94 is much larger when compared to prior art switches. This larger contact area reduces contact stress and results in increased switch lifetimes, lower failure rates and improved insertion loss.

Single-pole Double-throw Embodiment

Figure 5:
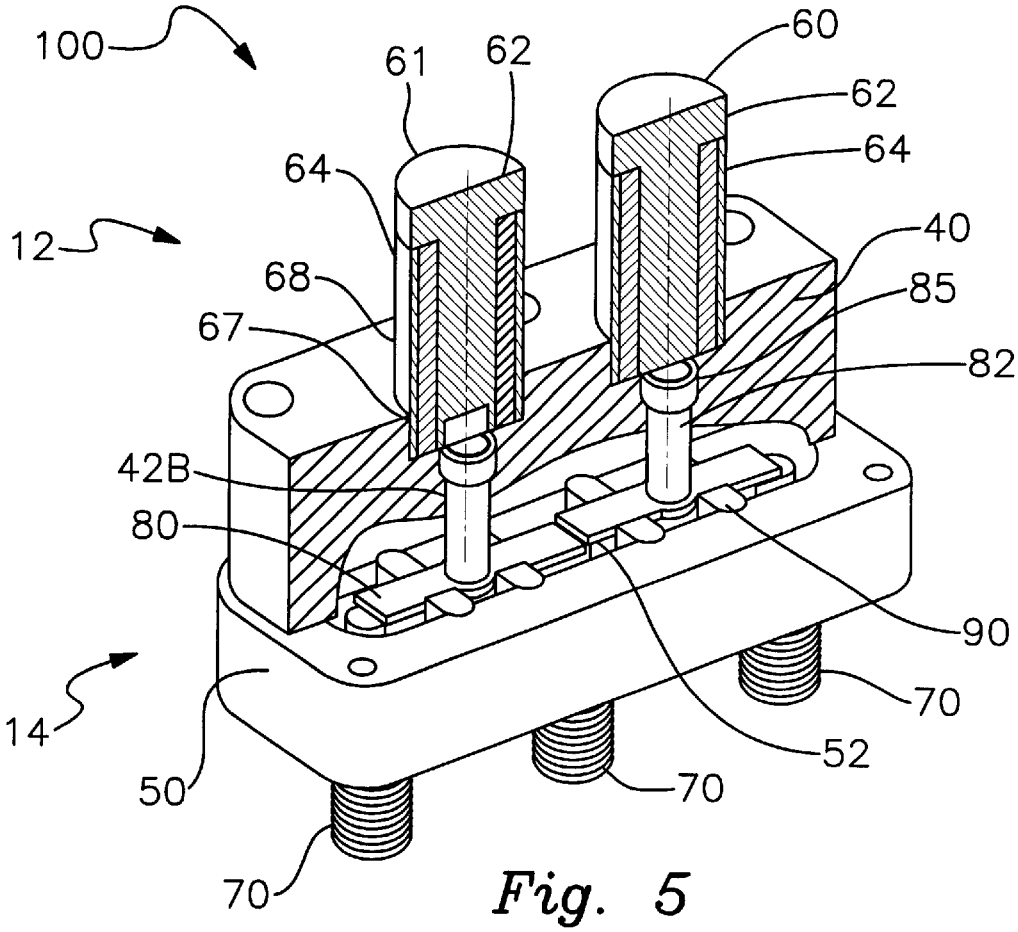
FIG. 5 is an assembled partial cut away view of a single pole double throw electromagnetic switch.

Referring to FIG. 5, a co-axial single-pole double-throw switch 100 is shown. Switch 100 is similar to switch 10 except that fewer contacts are switched. The switch 100 has an actuator 12 and RF subassembly 14. Base 50 has three terminals 70. Slots 52 contains two conductor reeds 80. Each conductor reed is held by a reed holder 82 with a permanent magnet 85 held at one end. The reed holders 82 are sized to fit within cylindrical bores 42B of the housing 40. The actuator 60 is mounted co-axial to reed holder 82 in housing 40. Actuator 60 has a core 62 and coil 64. In an energized condition, coil 64 creates a magnetic field with the same polarity as the polarity of the permanent magnet 85.

An actuator 61 is mounted co-axial to corresponding reed holder 82 with a permanent magnet 85. Core 62 has a cavity 67 with a permanent magnet 68. The polarity of magnet 68 is opposite to the polarity of magnet 85. In an energized condition coil 62 creates a magnetic field with a polarity the same as the permanent magnets 85. A guide member 90 is held in slots 52 as in FIG. 2. The guide members 90 guide the conductor reeds 80 during up and down movement. By activating the actuators 60 and 61, one reed 80 will be repulsed down to the closed position and at the same time another the other reed 80 will move up to an open position. The interaction of the actuators and conductor reeds are essentially the same for switch 100 as they are for switch 10.

Matrix Switch Embodiment

Figure 6:
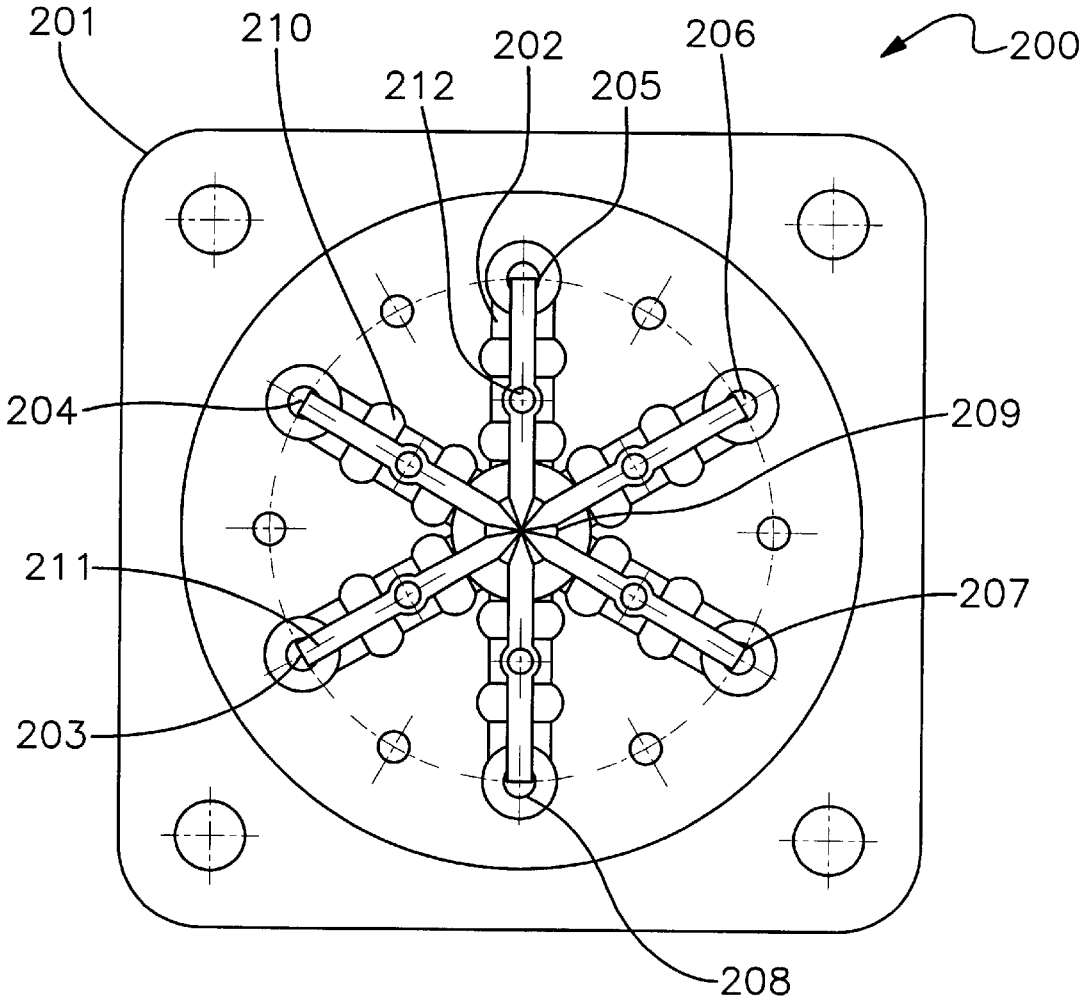
FIG. 6 is a top view of another embodiment that is a matrix electromagnetic switch.

Turning now to FIG. 6, a top view of a matrix switch device 200 is shown. The matrix switch device 200 has a RF sub-assembly housing base 201 with a plurality of RF cavities 202 are that are located in a radial direction and are equally spaced around housing base 201. In FIG. 6, six cavities 202 are mounted with six terminals 203, 204, 205, 206, 207, 208 and a central terminal 209. At least one guide member 210 is inserted symmetrically in each RF cavity 202. Conductor reeds 211 are located in RF cavities 202. The conductor reeds 211 are held by a plastic reed holder 212. The reeds 211 are driven by electromagnetic actuators (not shown in FIG. 6). The operation of matrix switch 200 is similar to the operation of switch 10. Matrix switch 200 allows for switching to occur between more terminals.

Alternative Embodiment

Figure 7:
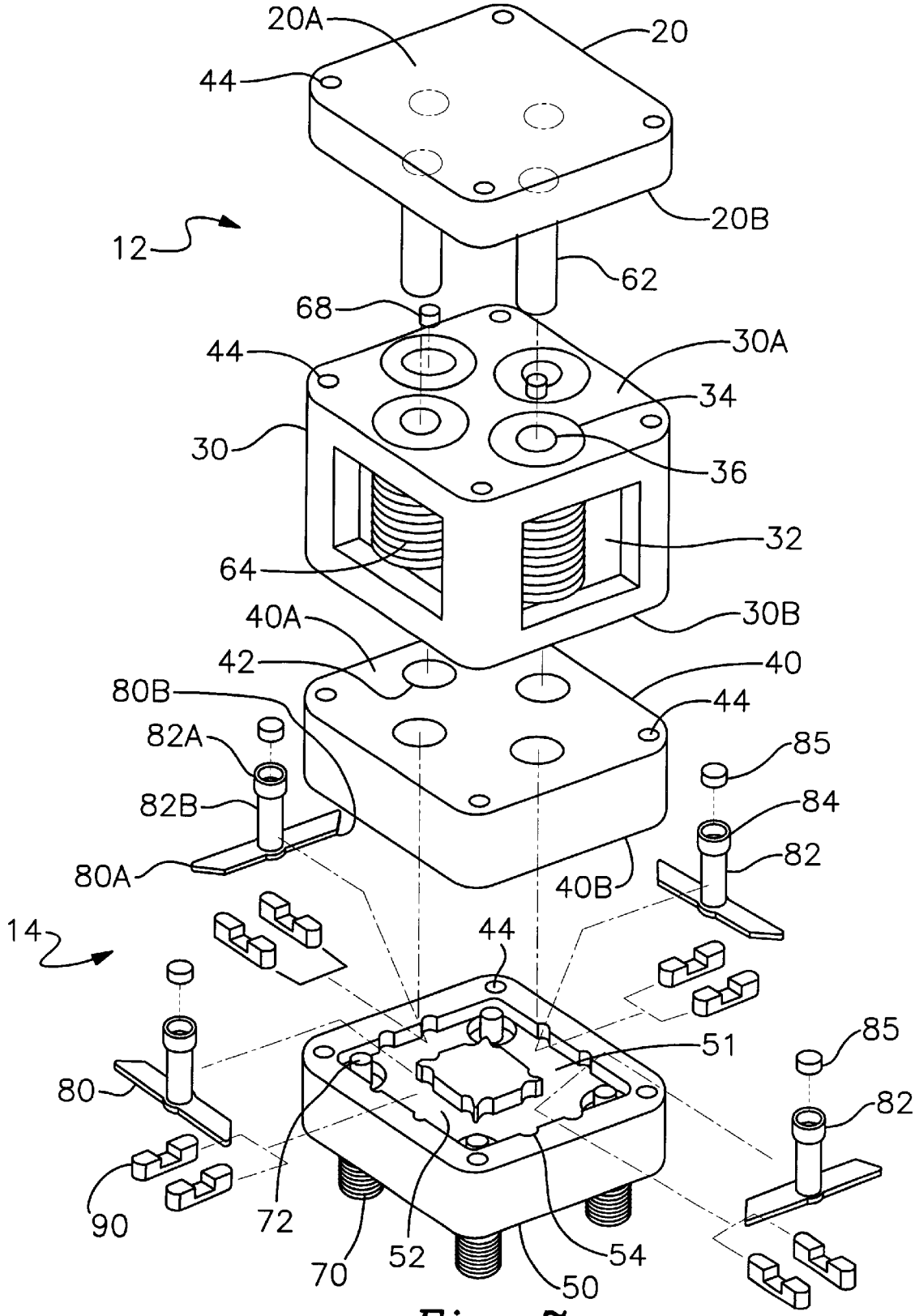
FIG. 7 is an exploded perspective view of another embodiment of an electromagnetic switch.
Figure 8:
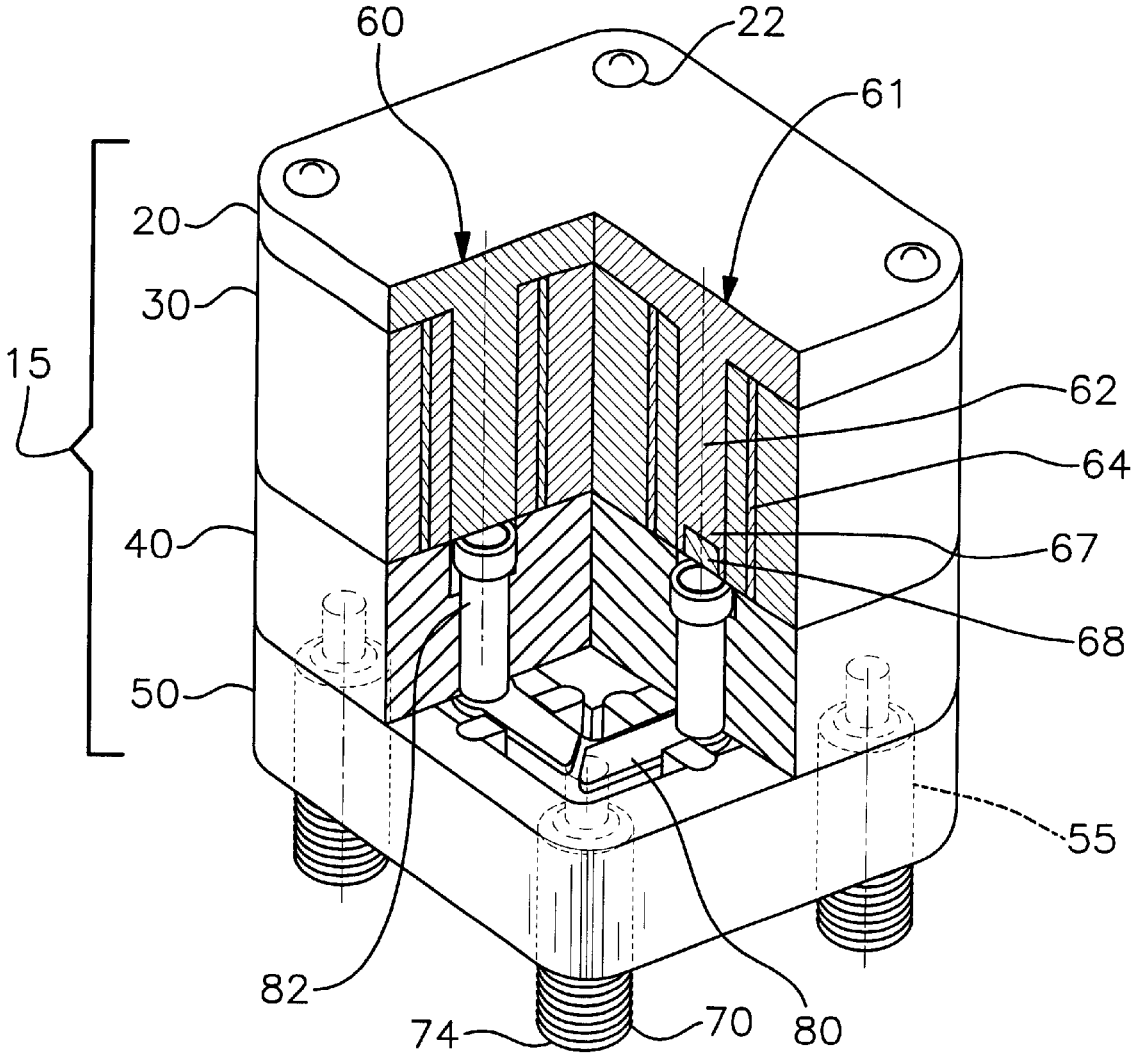
FIG. 8 is an assembled partial cut away view of FIG. 7.

Referring to FIGS. 7 and 8, another embodiment of a co-axial electromagnetic transfer switch 300 is shown.

Switch 300 has an actuator sub-assembly 12 and a radio frequency (RF) sub-assembly 14. Switch 300 is held in a housing 15. Housing 15 has a top 20, a coil holder 30, a case 40, and a base 50. Screws or bolts 22 hold the housing 15 together.

The actuator sub-assembly 12 includes a case 40 and actuators 60 and 61. Case 40 has a top surface 40A and bottom surface 40B. Case 40 has four bores 42 that extend through case 40. Holes 44 extend through case 40. Screws 22 pass through holes 44. An actuator or electromagnet 60 and 61 is formed in coil holder 30. Actuators 60 and 61 have a ferromagnetic core 62 that is attached to the bottom surface 20B of top 20. Coils or windings 64 are wound around a hollow tube 36. Coils 64 are mounted in holes 34 of coil holder 30. Cores 62 extend into tubes 36. Actuators 61 have a lower cavity 67 in core 62 that contains a fixed permanent magnet 68. The windings 64 are connected with a switchable source of electricity (not shown). The windings are wound so that the polarity of the generated magnetic field, when electricity is connected, is opposite that of the permanent magnet 68. In other words, the permanent magnet 68 will be repelled by the electromagnet when it is energized.

RF subassembly 14 has a base 50 with a fully sealed path or RF channel 51 that is sealed against electromagnetic interference. RF channel 51 is precision machined to produce a 50 ohm impedance. The fully sealed RF path or channel 51 is completely sealed against electromagnetic interference. Base 50 has a top surface 50A and a bottom surface 50B. Four adjoining slots 52 are located in top surface 50A. A center portion 53 is located adjacent to slots 52. Inner walls 58 are located on center portion 53. Outer walls 59 define slots 52. Recesses 54 are located in inner walls 58 and outer walls 59. Four terminal holes 55 extend from bottom surface 50B to the bottom of slots 52. Four bolt holes 44 extend through base 50.

Terminals 70 are affixed in terminal holes 55. Terminals 70 can be 50 ohm co-axial SMA connectors or TNC-type or type N radio frequency connectors. Terminals 70 can be press-fit or held by threads in holes 55. Terminals 70 have a contact tip 72 and a connector end 74. Contact tip 72 extends into slots 52 and is gold plated.

Four electrically conductive reeds 80 are located in slots 52. Reeds 80 have ends 80A and 80B. Reeds 80 are preferably made from a non-magnetic metal and are gold plated. Each of the connector reeds 80 is connected with a dielectric reed holder 82. Reed holder 82 is formed from PCTFE material or another dielectric material. Reed holder 82 has ends 82A and 82B. End 82B is mounted to the middle of reed 80. Reed holder end 82A extends into bore 42B. Reed holder 82 slides within bore 42B. Each reed holder end 82A has a cavity 84 that holds a permanent magnet 85. The polarity of permanent magnets 85 is opposite to the polarity of the other permanent magnets 68 mounted in cavity 67. The reed holders 82 are mounted coaxial to the corresponding axis of bores 42 or electromagnets 60 or 61.

A U-shaped guide member 90 is mounted into recesses 54. Reed 80 resides in and is supported by guide member 90. Guide member 90 has a base 92 with posts 94 extending from the base. The posts 94 partially reside in recesses 54. Two guide members 90 are located in each slot with the reed holder 82 mounted in between guide members 90. Guide members 90 are made from an insulative dielectric material such as Teflon. Reed 80 is slidably held for up and down movement by posts 94. Guide member 90 increases the lifetime of the RF switch by reducing stresses in the contact area between reeds 80 and guide posts 94. The use of guide member 90 reduces the switch cost by allowing the dimensions of the slot to be less precise than would otherwise be required. This eliminates cost consuming manufacturing operations such as cutting and assembly.

The operation of switch 300 is the same as for switch 10.

A skilled artisan will recognize that variations of the switch device 10 are possible. For example, the electromagnets could be arranged differently than was shown. Permanent magnets 68 could be replaced with compressed springs to move the reed to a closed position. More or fewer reeds, terminals and electromagnets could be used if desired depending upon the particular switching configuration that is needed. Even though the switching device shown was described for RF signals, switch device 10 could be used for any digital or analog signal from DC to very high frequencies.

The present invention has several advantages. The guide member 90 reduces wear of the reeds in the slots and limits rotation of the reeds. The reduced wear of the reeds leads to more stable insertion loss measurements. The guide member 90 reduces manufacturing costs by eliminating cost consuming manufacturing operations.

Electromagnetic switch device 10 has improved reliability, insertion loss stability and better manufacturability providing an improvement over previous RF switches.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the description. All changes that come within the meaning and range of equivalency of the claims are to be embraced within their scope.

What is claimed is:

1. An electromagnetic switch device comprising:

a) a base having at least one slot therein;

b) a first terminal mounted in the base and extending into the slot;

c) a second terminal mounted in the base and extending into the slot;

d) at least one guide member mounted in the slot;

e) an electrically conductive reed mounted in the guide member and extending along the slot, the reed movable between a first position in which the first and second terminals are electrically connected and a second position in which the first and second terminals are electrically disconnected; and f) an actuator, mounted adjacent to the base and coupled to the reed, the actuator operable to move the reed between the first and second positions, the guide member reducing wear of the reed as it moves.

2. The electromagnetic switch device according to claim 1, wherein the guide member is U-shaped.

3. The electromagnetic switch device according to claim 2, wherein the guide member has a base and a pair of posts extending from the base.

4. The electromagnetic switch device according to claim 3, wherein the slot has a pair of recesses located on each side of the slot, the guide member mounted in the recesses.

5. The electromagnetic switch device according to claim 1, wherein the actuator comprises:

a) a housing;

b) a case mounted in the housing;

c) an electromagnet mounted in the case;

d) a reed holder having a first and a second end, the first end mounted to the reed; and e) a first permanent magnet mounted to the second end of the reed holder, the permanent magnet mounted adjacent the electromagnet, the electromagnet operable to attract and repel the permanent magnet such that the reed moves between the first and second positions.

6. The electromagnetic switch device according to claim 5, wherein the second end of the reed holder has a cavity, the first permanent magnet mounted in the cavity.

7. The electromagnetic switch device according to claim 5, wherein the first end of the reed holder is mounted to the middle of the reed.

8. The electromagnetic switch device according to claim 5, wherein the housing has a bore extending therethrough, the reed holder located in the bore.

9. The electromagnetic switch device according to claim 5, wherein the electromagnet has a core having a plurality of windings thereon, the windings connectable and disconnectable with an electrical power source.

10. The electromagnetic switch device according to claim 9, wherein the core has a cavity, a second permanent magnet mounted in the cavity, the second permanent magnet having a polarity opposite that of the first permanent magnet.

11. The electromagnetic switch device according to claim 10, wherein four actuators are mounted in the housing and four reeds are mounted in the base, two of the actuators having the second permanent magnet such that when the electromagnets are disconnected with the electrical power source two of the reeds are in the first position and two of the reeds are in the second position.

12. The electromagnetic switch device according to claim 1, wherein the guide member prevents the rotation of the reed within the slot as the reed moves between the first and second positions.

13. An electromagnetic switching device comprising:

a) a housing having a base and a case, the case having a bore and the base having a slot;

b) at least one electromagnet mounted in the case;

c) at least one reed holder having a first and second end, the first end mounted in the bore adjacent the electromagnet;

d) a first and second terminal mounted in the base and extending into the slot;

e) at least one guide member mounted in the slot; and f) an electrically conductive reed mounted to the second end of the reed holder, the reed supported by the guide member and extending over the terminals, the electromagnet being adapted to move the reed between a first position in which the first and second terminals are electrically connected and a second position in which the first and second terminals are electrically disconnected, the guide member preventing rotation of the reed as it moves between the first and second positions.

14. The electromagnetic switch device according to claim 13, wherein two guide members are located in each slot supporting the reed.

15. The electromagnetic switch device according to claim 14, wherein the guide member is U-shaped and has a pair of posts that retain the reed.

16. The electromagnetic switch device according to claim 15, wherein the second end of the reed holder is located between the guide members.

17. The electromagnetic switch device according to claim 16, wherein a pair of walls are located on each side of the slot, a recess located in each wall, the guide member mounted in the recesses.

18. The electromagnetic switch device according to claim 17, wherein the posts are mounted in the recesses.

19. The electromagnetic switch device according to claim 14, wherein the guide member is U-shaped and has a pair of posts that retain the reed, the reed in sliding contact with the posts.

20. The electromagnetic switch device according to claim 19, wherein the second end of the reed holder is located between the guide members.

21. The electromagnetic switch device according to claim 13, wherein the terminals are co-axial connectors.

22. The electromagnetic switch device according to claim 13, wherein a first permanent magnet is mounted to the first end of the reed holder, the electromagnet being adapted to attract and repel the first permanent magnet such that the reed moves between the first and second positions.

23. The electromagnetic switch device according to claim 22, wherein the first end of the reed holder has a cavity, the first permanent magnet mounted in the cavity.

24. The electromagnetic switch device according to claim 22, wherein the electromagnet has a core having a plurality of windings, the windings connectable and disconnectable with an electrical power source.

25. The electromagnetic switch device according to claim 24, wherein the polarity of a magnetic field generated by the electromagnet is opposite that of the first permanent magnet.

26. The electromagnetic switch device according to claim 24, wherein the core has a cavity, a second permanent magnet mounted in the cavity, the second permanent magnet having a polarity opposite that of the first permanent magnet such that the first and second permanent magnets repel each other.

27. The electromagnetic switch device according to claim 26, wherein a first reed is mounted to a first reed holder and is mounted in the case with the first and second permanent magnet, a second reed is mounted to a second reed holder and is mounted in the case with the first permanent magnet, such that when the electromagnets are disconnected with the electrical power source the first reed is in the first position and the second reed is in the second position, when the electromagnets are connected with the electrical power source the first reed is in the second position and the second reed is in the first position.

28. An electromagnetic switching device comprising:

a) a housing having a base and a case, the case having a plurality of bores and the base having a plurality of slots;

b) a plurality of electromagnets mounted in the case;

c) a plurality of reed holders, each reed holder having a first and second end, the first end mounted in the bore adjacent the electromagnet;

d) a common terminal extending through the base;

e) a plurality of first terminals extending through the base around the common terminal;

f) a plurality of guide members mounted in the slots; and g) a plurality of electrically conductive reeds mounted to the second end of the reed holder, the reed supported by the guide member and extending over the terminals, the electromagnet being adapted to move the reed between a closed position in which the first and second terminals are electrically connected by the reed and an open position in which the first and second terminals are electrically disconnected, the guide member being adapted to support the reed while allowing movement between the reed and the guide member.

29. The electromagnetic switch device according to claim 28, wherein the reed has a first and a second end, the first end located over the common terminal and the second end located over the first terminal.

30. The electromagnetic switch device according to claim 29, wherein the reeds extend radially outward from the common terminal toward the first terminals.

31. The electromagnetic switch device according to claim 30, wherein two guide members are located in each slot supporting the reed.

32. The electromagnetic switch device according to claim 28, wherein a pair of walls are located on each side of the slot, a recess located in each wall, the guide member mounted in the recesses.

33. The electromagnetic switch device according to claim 28, wherein the terminals are co-axial connectors.

34. The electromagnetic switch device according to claim 28, wherein a first permanent magnet is mounted to the first end of the reed holder, the electromagnet being adapted to attract and repel the first permanent magnet such that the reed moves between the open and closed positions.

35. The electromagnetic switch device according to claim 34, wherein the first end of the reed holder has a cavity, the first permanent magnet mounted in the cavity.

36. The electromagnetic switch device according to claim 34, wherein the electromagnet has a core having a plurality of windings, the electromagnet generating a magnetic field having a polarity.

37. The electromagnetic switch device according to claim 36, wherein the polarity of the magnetic field is opposite that of the first permanent magnet.

38. The electromagnetic switch device according to claim 37, wherein the core has a cavity, a second permanent magnet mounted in the cavity, the second permanent magnet having a polarity opposite that of the first permanent magnet such that the first and second permanent magnets repel each other.

* * * * *